US007866260B1

(12) United States Patent
Clark et al.

(10) Patent No.: US 7,866,260 B1
(45) Date of Patent: Jan. 11, 2011

(54) DEFORMABLE PADS FOR ROTARY PAD PRINTING, APPARATUS AND METHOD

(76) Inventors: Lloyd Douglas Clark, 15 Conrad St., San Francisco, CA (US) 94131-2924; Brian A. Brown, 325 Lake St., San Francisco, CA (US) 94118

( * ) Notice: Subject to any disclaimer, the term of this patent is extended or adjusted under 35 U.S.C. 154(b) by 704 days.

(21) Appl. No.: 11/852,301

(22) Filed: Sep. 8, 2007

Related U.S. Application Data

(60) Provisional application No. 60/825,304, filed on Sep. 12, 2006.

(51) Int. Cl.
*B41F 17/34* (2006.01)

(52) U.S. Cl. ..... 101/41; 101/42; 101/44; 101/33; 101/35

(58) Field of Classification Search ..... 101/41, 101/42, 44, 33, 35
See application file for complete search history.

(56) References Cited

U.S. PATENT DOCUMENTS

| | | | | |
|---|---|---|---|---|
| 5,404,819 | A * | 4/1995 | Hishinuma et al. | 101/425 |
| 6,276,266 | B1 | 8/2001 | Dietz et al. | |
| 6,840,167 | B2 | 1/2005 | Clark et al. | |
| 2003/0136281 | A1 | 7/2003 | Clark et al. | |
| 2007/0144364 | A1 * | 6/2007 | Hitchcock | 101/41 |

FOREIGN PATENT DOCUMENTS

| | | | |
|---|---|---|---|
| DE | 3820340 | C1 | 6/1988 |
| DE | 4020223 | C1 | 6/1990 |

OTHER PUBLICATIONS

U.S. Appl. No. 60/792,254, filed Apr. 14, 2006, L.D. Clark et al.
U.S. Appl. No. 11/464,203, filed Aug. 13, 2006, L.D. Clark et al.
U.S. Appl. No. 11/558,911, filed Nov. 11, 2006, L.D. Clark et al.
Author Unknown, "New PadJet™ Digital Pad Printing System", Graphics Pro Magazine, Sep.-Oct. 2004.

* cited by examiner

*Primary Examiner*—Ren Yan
*Assistant Examiner*—Shema T Freeman

(57) ABSTRACT

A rotary pad for pad printing comprises a cylinder (100') or a belt (1105). The pad can be either flat or crowned in its relaxed condition. An ink applicator (405, etc.) applies an ink image (701) to the pad for subsequent transfer to a receiving object (425, etc.). If not initially flat, the pad can be flattened during application of the ink image, then forced to bulge for transfer to a receiving object. The pad can be flattened or caused to bulge by rollers (400, etc.) or by vacuum or pneumatic pressure. In one embodiment, an ink image is temporarily applied to the outer surface (510) of a flat cylindrical pad, then as the pad rotates, the sides of the pad are squeezed by rollers (520, 525), forcing the pad to bulge during transfer of the ink image to a receiving object (600). In another embodiment, a crowned pad (100') is flattened while accepting an ink image, then allowed to resume its original crowned shape for transfer to a receiving object (425).

17 Claims, 14 Drawing Sheets

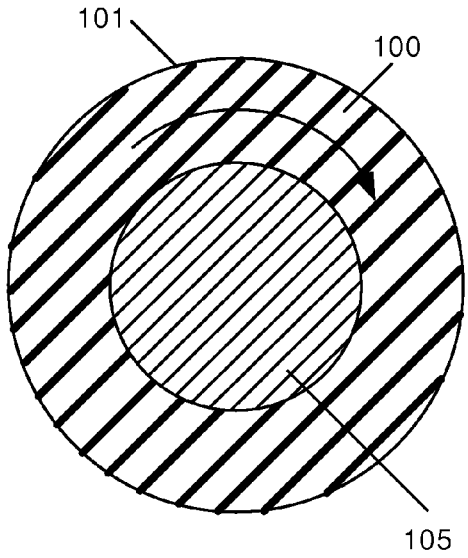
Fig. 1A--Prior Art
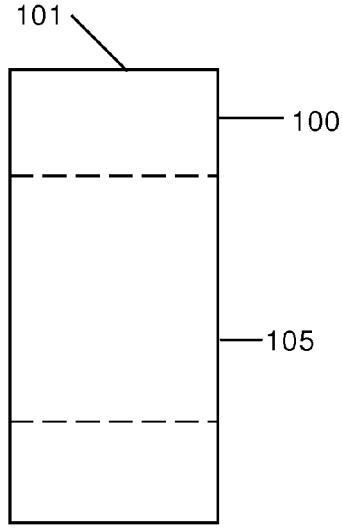
Fig. 1B--Prior Art
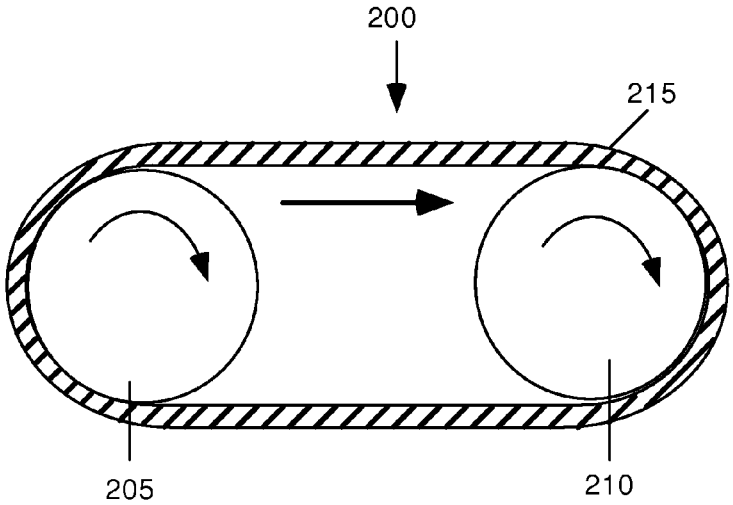
Fig. 2A--Prior Art
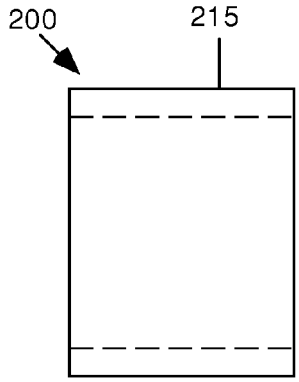
Fig. 2B--Prior Art

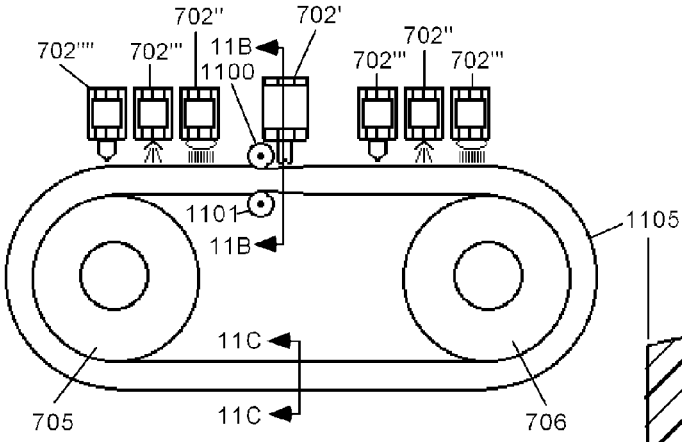
Fig. 11A
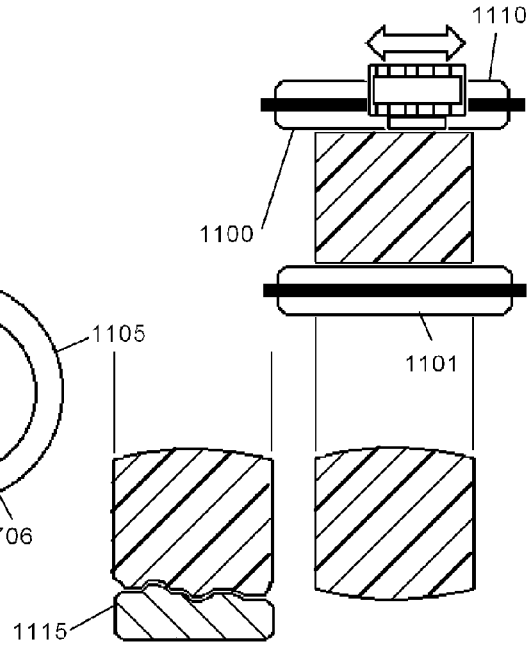
Fig. 11C
Fig. 11B
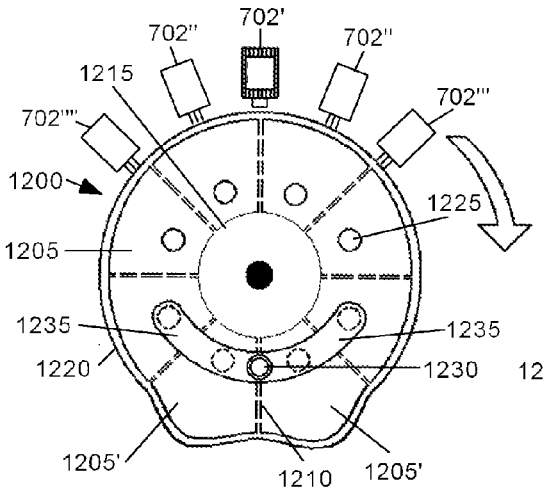
Fig. 12A
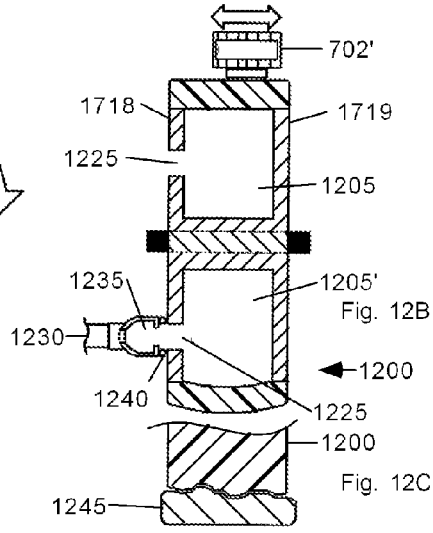
Fig. 12B
Fig. 12C

DEFORMABLE PADS FOR ROTARY PAD PRINTING, APPARATUS AND METHOD

CROSS-REFERENCE TO RELATED APPLICATIONS

This application claims priority of our provisional patent application Ser. No. 60/825,304, filed Sep. 12, 2006. This application is related to and incorporates for reference purposes our U.S. Pat. No. 6,840,167 (2005) and our pending U.S. patent application Ser. No. 11/464,203, filed Aug. 13, 2006, Ser. No. 11/558,911, filed Nov. 11, 2006, Ser. No. 11/697,171, filed Apr. 5, 2007, and Ser. No. 11/777,166, filed Jul. 12, 2007.

BACKGROUND

1. Field

The field is pad printing, and in particular rotary transfer pad printing.

2. Prior Art

Fixed Pad Printing

Prior-art, fixed-pad printing is used to apply images and text to either flat or uneven surfaces ranging from poker chips and golf balls to household appliance panels. Such printing usually employs a domed pad. The pad is made of an elastomeric material such as gelatin or a silicone rubber. The surface of a flat, metal or plastic plate is etched to a depth of about 0.025 mm with an image. The etched plate is called a cliché. The pad is pressed against the cliché, flattening the domed portion and contacting the ink in the image. The pad is then lifted away from the cliché, carrying the ink image with it. The pad is then moved to a position in proximity with a receiving surface. The pad is then pressed against the receiving surface, again deforming its domed shape, until all image areas are in contact with the receiving surface. The pad is then lifted away from the receiving surface, leaving behind the ink image on the surface. This completes the transfer of the image from the cliché to the receiving surface.

The pad is domed to prevent the entrapment of air during the inking and transfer steps. Air entrapped during these operations would form pockets which would be undesirable since such pockets could release their contents in unpredictable ways, causing the ink image to smear across the surface of the cliché or the receiving surface.

Pad printing is most useful when the surface to be printed is uneven, i.e., wavy or contoured. The pad can carry the ink image to all points on the receiving surface since it is deformable and thus can conform to such points.

Pad Printing

Our U.S. Pat. No. 6,840,167 (2005) teaches a multicolor and multi-layer apparatus for pad printing using a deformable pad. This apparatus is generally limited to printing images that are the same size or smaller than the pad itself.

Rotary Pad Printing

In the past, rotary pad printing has been used to decorate objects by printing images or text thereon. In its simplest form, a rotary pad printing apparatus comprises a rotary pad that comprises a multi-layer, right-circular cylinder having a compressible surface that is usually made of silicone rubber. The cylinder is first inked using a cliché and then brought into rolling contact with a receiving surface such as a bottle or a syringe. This method of pad printing is best used with monochrome images that are applied over a limited area.

Co-Pending Application

In our above co-pending application Ser. No. 11/777,166, we teach a method and apparatus for rotary pad printing that overcomes many of the prior-art limitations. Although this system provides a significant improvement in pad printing technology, there remains at least one area for improvement. In the prior-art rotary pad printing systems, the surface of the pad remains flat in its axial direction. I.e., the rotary pad assembly comprises a right-circular cylinder. In another aspect of the embodiment, the rotary pad is replaced by a belt. The belt offers the same opportunity for improvement.

Rotary Pad Printing Apparatus—FIGS. 1 and 2

A prior art rotary pad printing wheel, as shown in FIGS. 1A and 1B, comprises a silicone rubber cylinder 100 having an outer surface 101 and formed around a metal shaft 105. In use, ink is applied image-wise to surface 101 at a known inking station (not shown), and then subsequently transferred to a receiving surface (not shown) as the pad rotates in contact with the receiving surface.

Similarly, a prior art rotary belt, taught in our above co-pending application Ser. No. 11/777,166 and indicated in FIGS. 2A and 2B, comprises a silicone rubber belt 200 having a surface 215, and rollers 205 and 210. One or both of rollers 205 and 210 propel and support belt 200. An inking station (not shown) applies an ink image to surface 215 of belt 200 at one location, and the ink is subsequently applied to a receiving surface (not shown) as belt 200 traverses its path and comes into contact with the receiving surface.

In both of the above-described cases, the receiving surface and the surface of the pad or belt are stationary with respect to one-another during transfer to avoid smearing of the ink image. This apparatus is best suited to printing cylindrical surfaces whose axis is either parallel to or perpendicular to the axis of rotation of the pad wheel or belt.

SUMMARY

In accordance with one aspect of a first embodiment, a pad for use in a rotary pad printing apparatus is provided that remains unbulged or optionally transitions between a non-bulged state and a bulged state. In accordance with one aspect of another embodiment, a pad belt for use in rotary pad printing apparatus is provided that remains unbulged or optionally transitions between a non-bulged state and a bulged state. By bulging in a direction normal to the direction of travel of the surface of the pad wheel or belt, an improved non-moving pad is achieved. The best aspects of both rotary and fixed pad printing are combined. In addition, an image can be printed whose length is greater than the circumference of the pad.

DRAWING FIGURES

FIGS. 1A and 1B show cross-sectional and side views, respectively, of a prior-art, rotary pad printing pad.

FIGS. 2A and 2B show cross-sectional and side views of a pad printing belt, as taught in our above co-pending application Ser. No. 11/777,166.

Figure 5:
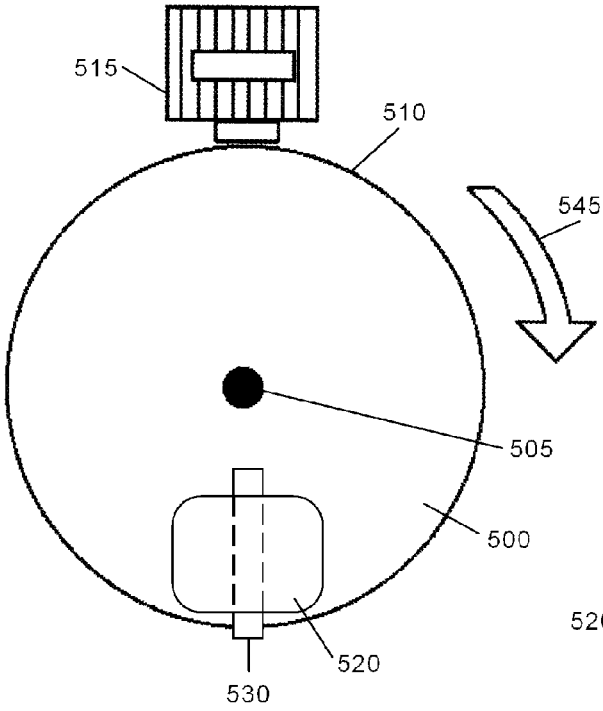
Figure 6A:
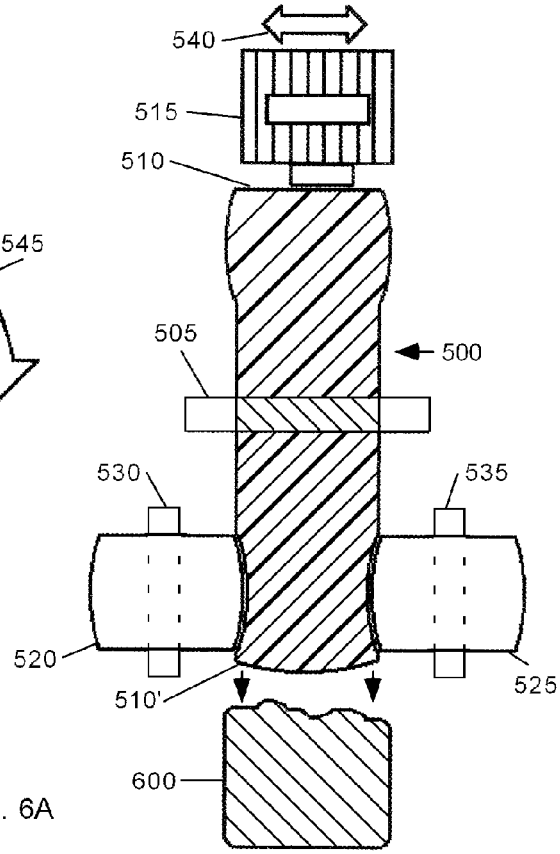
Figure 6B:
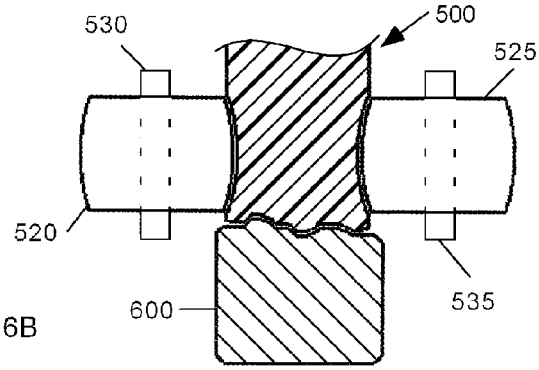

FIGS. 5, 6A, and 6B show side and cross-sectional views of a system for temporarily bulging a non-crowned rotary printing pad.

FIGS. 7 through 10 show side and cross-sectional views of a system for temporarily bulging a normally flat pad printing belt.

FIGS. 11A through 11C show side and cross-sectional views of a normally crowned belt pad that is flattened for application of an ink image and optional coatings and treatments.

FIGS. 12A through 12C show side and cross-sectional views of a pad that is deformable by the application of gas pressure.

Figure 13A:
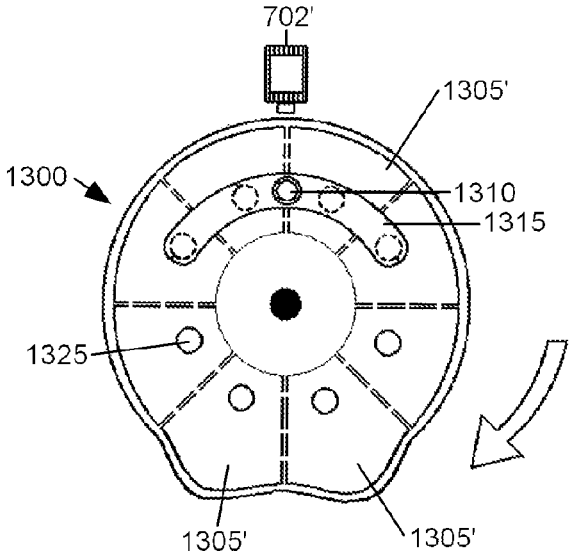
Figure 13B:
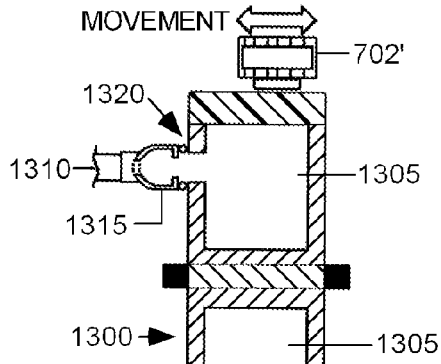
Figure 13C:
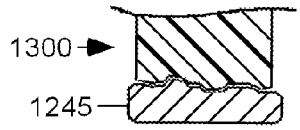

FIGS. 13A through 13C show side and cross-sectional views of a pad that is flattened by the application of a vacuum.

Figure 14A:
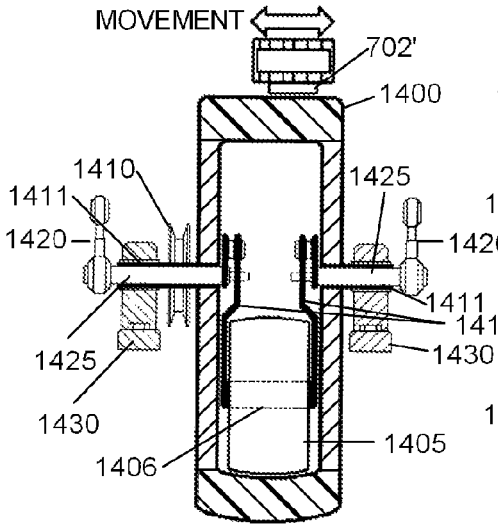
Figure 14B:
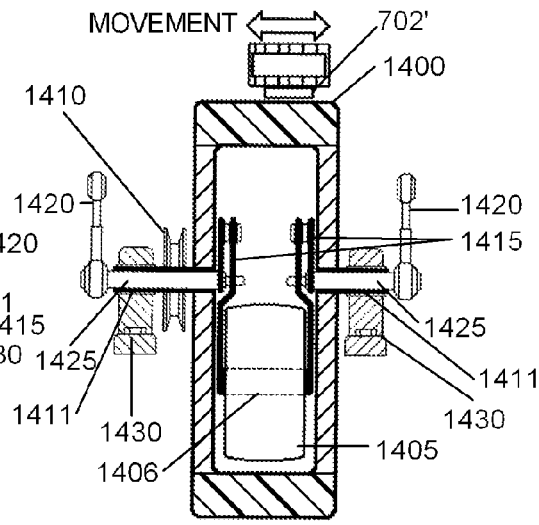

FIGS. 14A and 14B show cross-sectional views of a pad that is bulged by an internal mechanical mechanism.

Figure 15A:
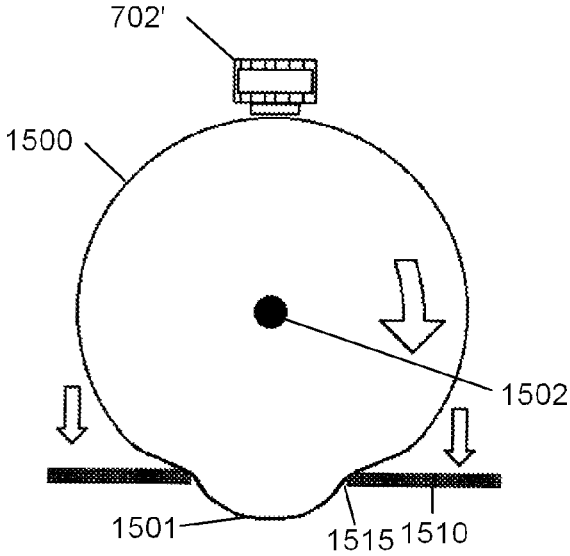
Figure 15B:
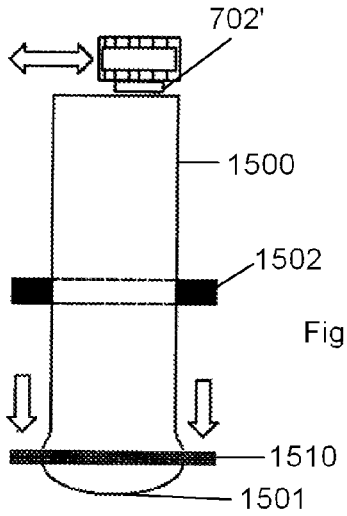
Figure 15C:
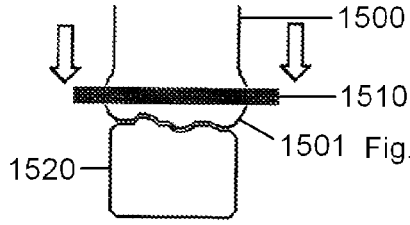

FIGS. 15A through 15C show side and frontal views of a rotary pad that is radially bulged by forcing it against a hole in a plate.

Figure 16:
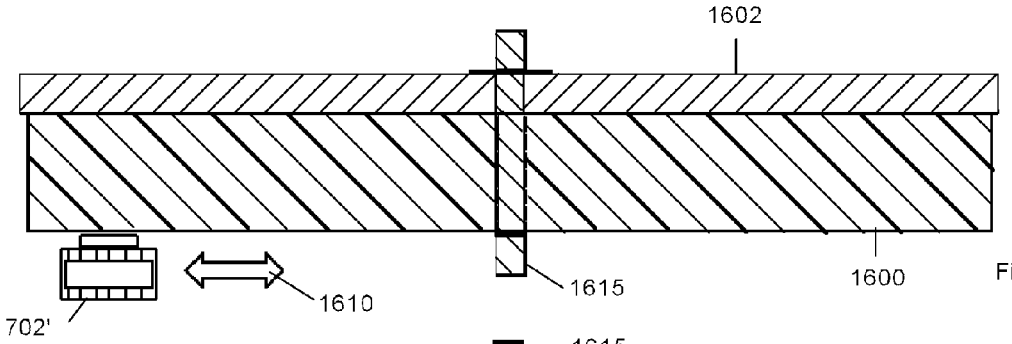
Figure 17:
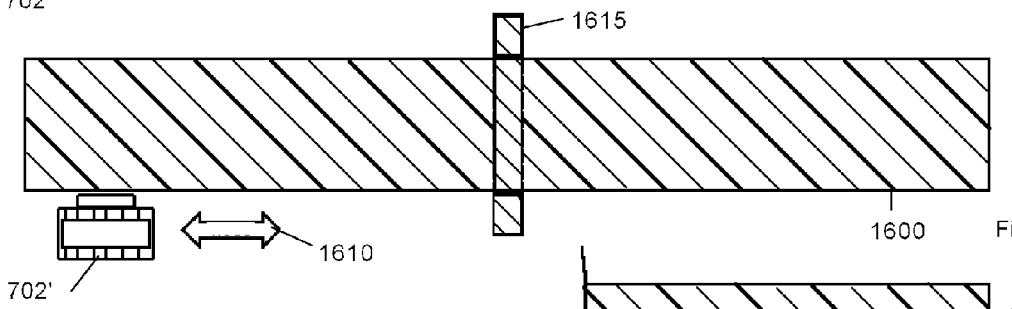
Figure 18:
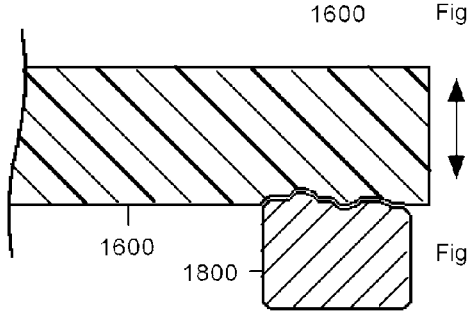

FIGS. 16 through 18 show cross-sectional views of pads configured for side-of-the-pad writing and transfer.

Figure 19:
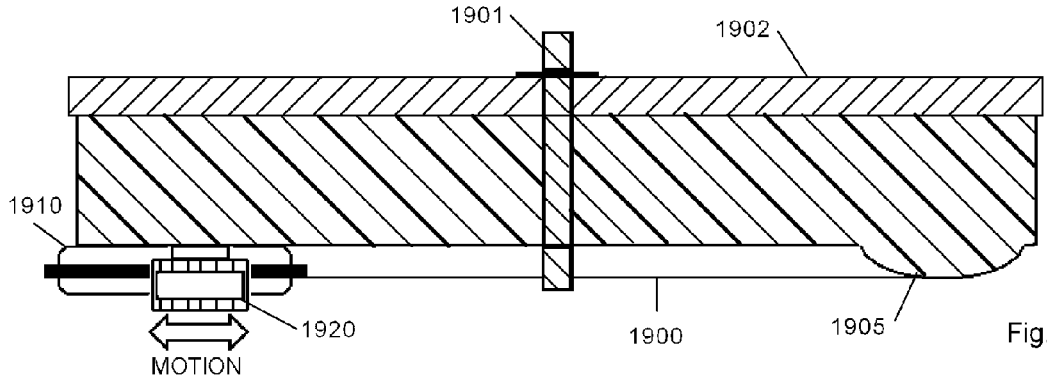
Figure 20:
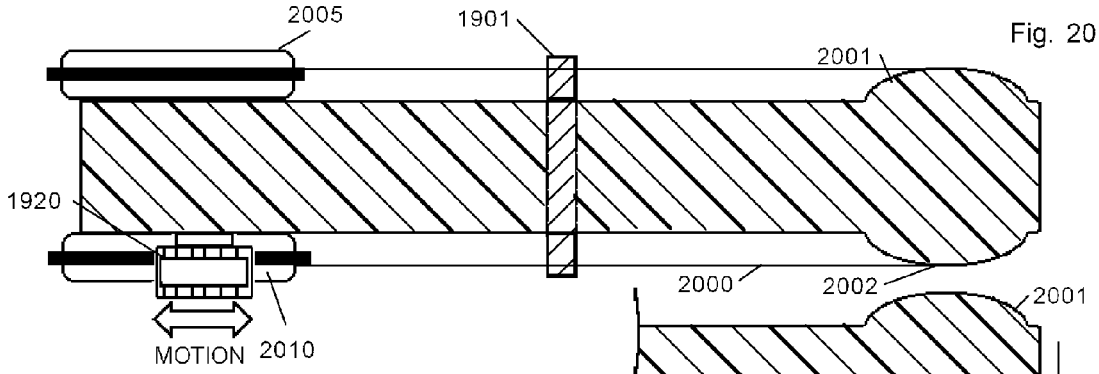
Figure 21:
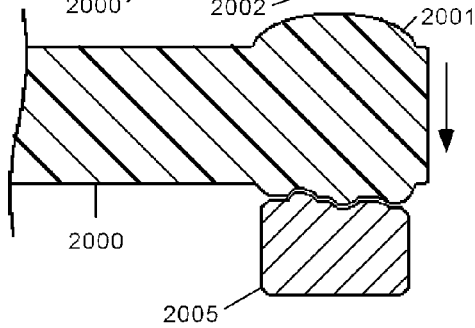

FIGS. 19 through 21 show cross-sectional views of a bulged variation of the pads in FIGS. 16-18.

Figures 22, 23:
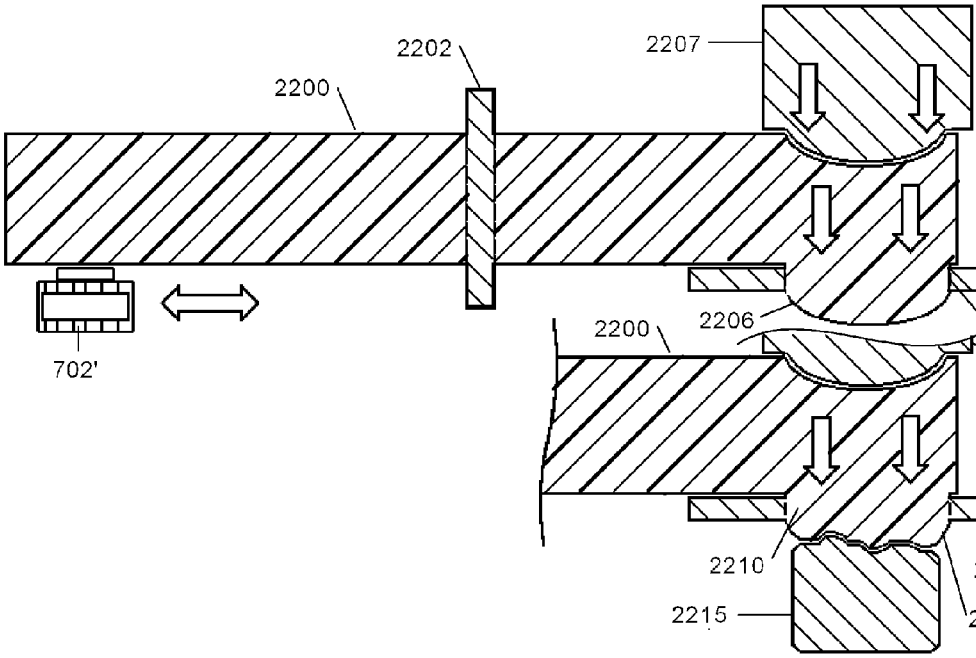

FIGS. 22 and 23 show cross-sectional views of a pad that is axially-bulged by forcing it against a hole in a plate.

Figure 24:
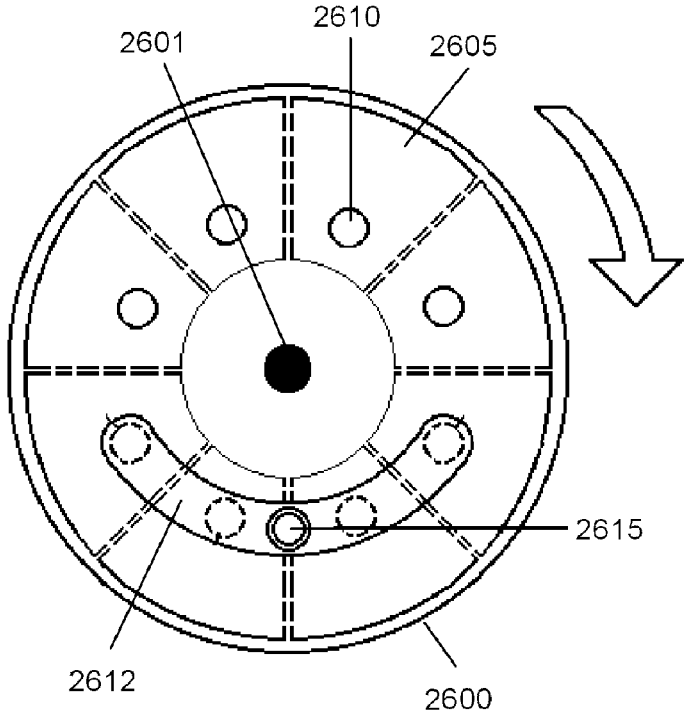
Figure 26:
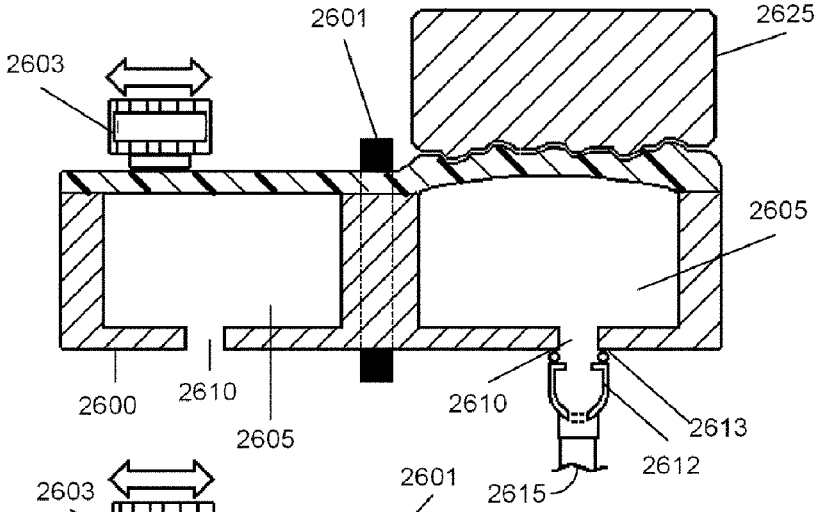
Figure 25:
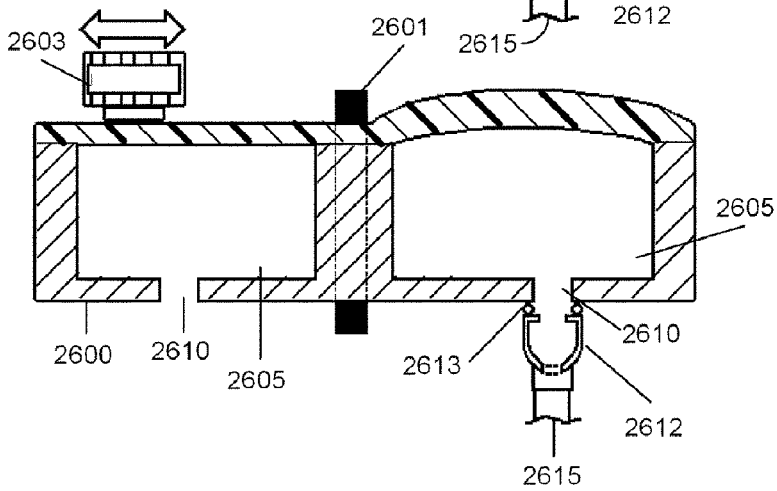

FIGS. 24 through 26 show side and cross-sectional views of a normally flat, axial-writing and transferring pad that is activated by application of gas pressure to internal chambers.

Figure 29:
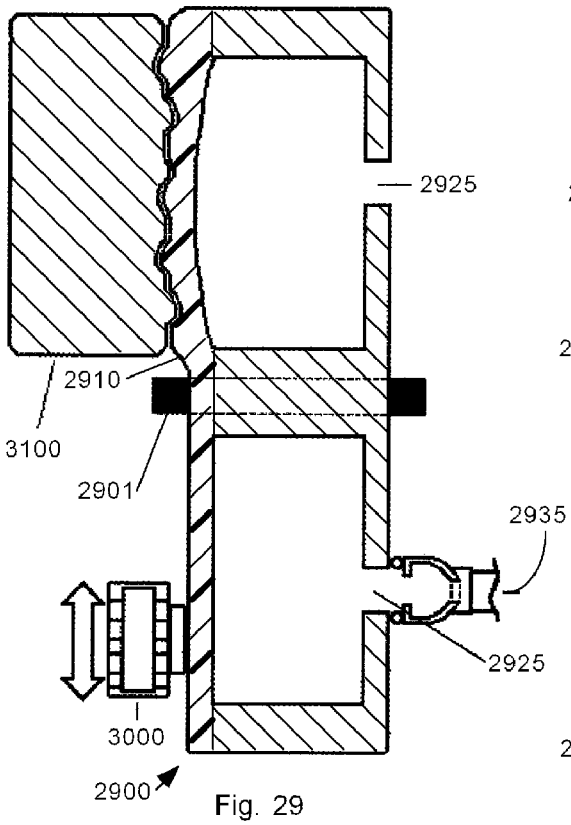
Figure 28:
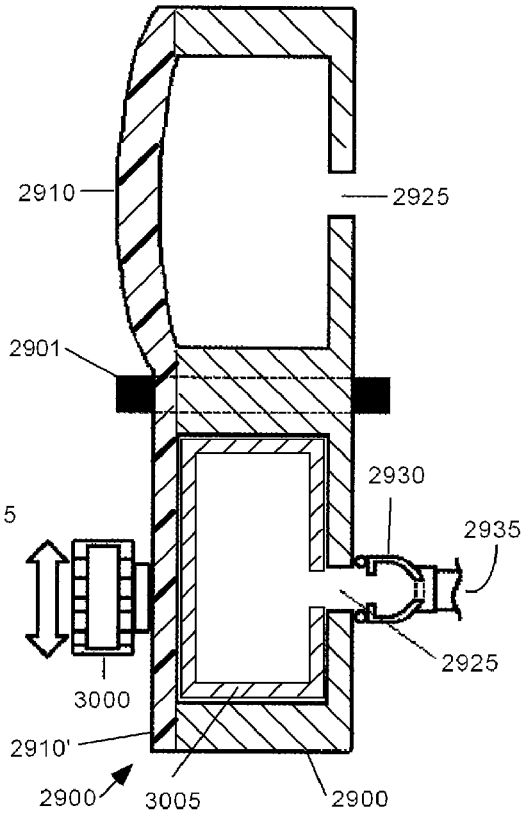
Figure 27:
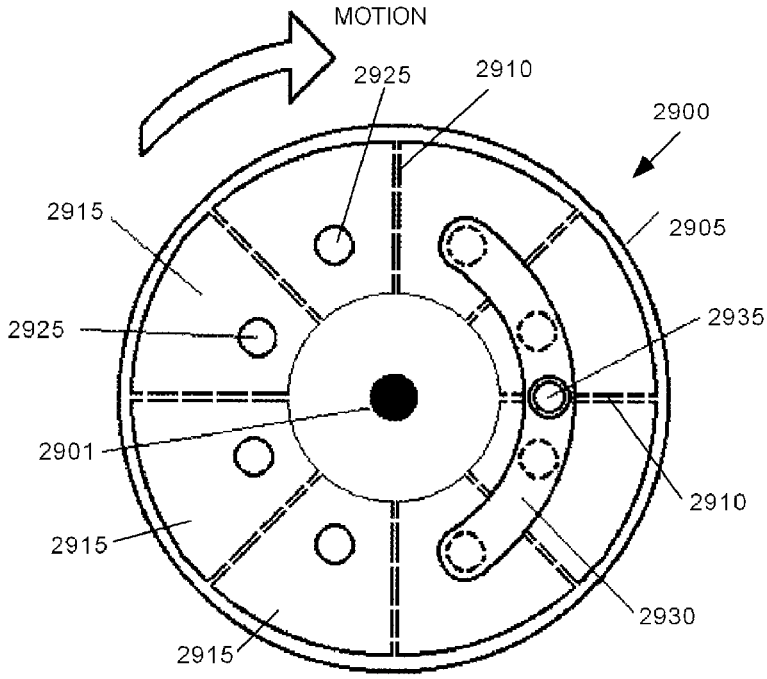

FIGS. 27 through 29 show side and cross-sectional views of a normally bulged, axial writing and transferring pad that is flattened during the ink, coatings, and treatments writing process by application of a vacuum to internal chambers.

Figure 30:
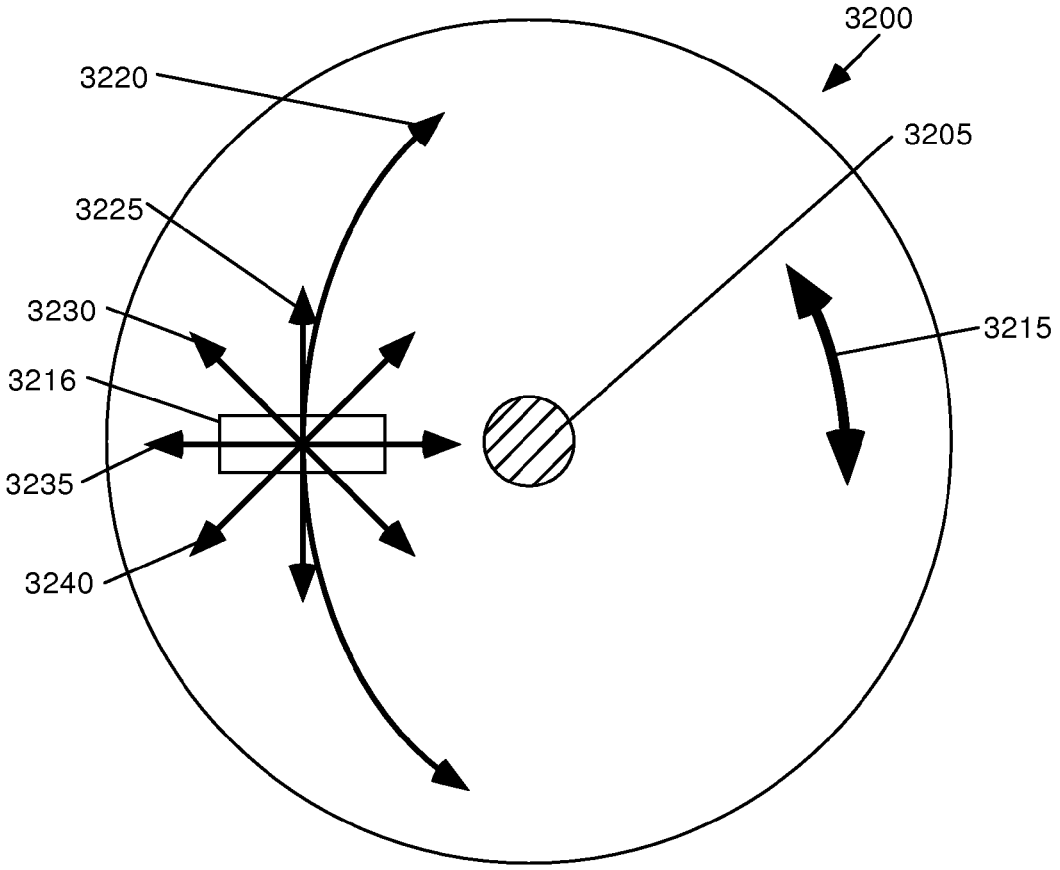
Figure 31:
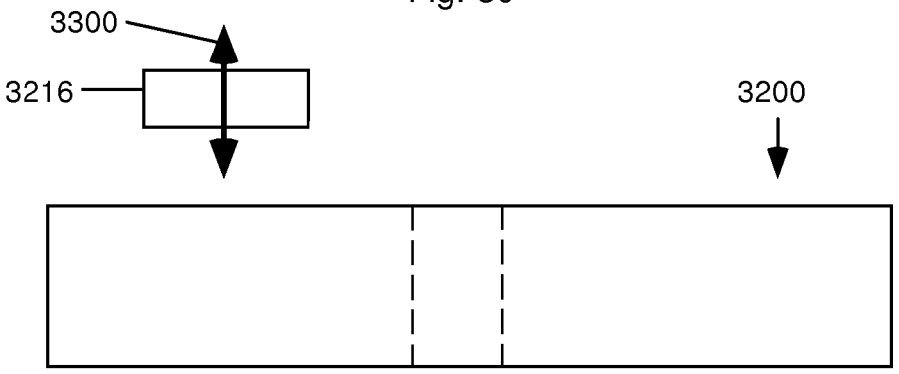

FIGS. 30 through 31 show various orientations and movements of writing heads and the pad during application of inks, coatings, and treatments to the side of a pad.

FIGS. 32 through 36 show various orientations and movements of a writing head and the pad during application of inks, coatings, and treatments to the outside surface of a pad wheel.

DRAWING FIGURE REFERENCE NUMERALS

| DRAWING FIGURE REFERENCE NUMERALS | |
|---|---|
| 100 | Pad |
| 101 | Surface |
| 105 | Shaft |
| 200 | Belt |
| 205 | Roller |
| 210 | Roller |
| 215 | Surface |
| 400 | Roller |
| 405 | Source |
| 410 | Drop |
| 415 | Image |
| 420 | Surface |
| 425 | Object |
| 430 | Station |
| 431 | Roll |
| 432 | Shaft |
| 433 | Guide |
| 434 | Guide |
| 435 | Roll |
| 500 | Pad |
| 505 | Axle |
| 510 | Surface |
| 515 | Assembly |
| 520 | Roller |
| 525 | Roller |
| 530 | Axle |
| 535 | Axle |
| 540 | Arrow |
| 600 | Object |
| 700 | Belt |

-continued

| DRAWING FIGURE REFERENCE NUMERALS | |
|---|---|
| 701 | Image |
| 702 | Station |
| 705 | Wheel |
| 706 | Wheel |
| 710 | Roller |
| 711 | Axis |
| 715 | Roller |
| 720 | Roller |
| 721 | Axis |
| 725 | Axis |
| 1100 | Roller |
| 1105 | Belt |
| 1115 | Object |
| 1200 | Pad |
| 1205 | Chamber |
| 1210 | Wall |
| 1215 | Portion |
| 1220 | Wall |
| 1225 | Hole |
| 1230 | Source |
| 1235 | Plenum |
| 1240 | Seal |
| 1300 | Pad |
| 1305 | Chamber |
| 1315 | Plenum |
| 1320 | Joint |
| 1325 | Hole |
| 1400 | Pad |
| 1405 | Wheel |
| 1406 | Shaft |
| 1410 | Pulley |
| 1411 | Axle |
| 1415 | Arm |
| 1420 | Arm |
| 1425 | Shaft |
| 1430 | Bearing |
| 1435 | Head |
| 1500 | Pad |
| 1501 | Portion |
| 1502 | Axle |
| 1505 | Head |
| 1510 | Plate |
| 1515 | Hole |
| 1520 | Object |
| 1600 | Pad |
| 1602 | Plate |
| 1605 | Head |
| 1610 | Arrow |
| 1615 | Axle |
| 1718 | Wall |
| 1719 | Wall |
| 1800 | Object |
| 1900 | Pad |
| 1902 | Plate |
| 1905 | Region |
| 1910 | Surface |
| 1920 | Head |
| 2000 | Pad |
| 2001 | Bulge |
| 2002 | Bulge |
| 2005 | Roller |
| 2010 | Roller |
| 2200 | Pad |
| 2202 | Axis |
| 2204 | Head |
| 2205 | Plate |
| 2206 | Region |
| 2207 | Anvil |
| 2210 | Aperture |
| 2215 | Object |
| 2400 | Pad |
| 2600 | Pad |
| 2601 | Axis |
| 2603 | Station |
| 2605 | Chamber |
| 2610 | Hole |
| 2612 | Plenum |

-continued

| DRAWING FIGURE REFERENCE NUMERALS | |
|---|---|
| 2613 | Sea |
| 2615 | Source |
| 2620 | Object |
| 2625 | Object |
| 2900 | Pad |
| 2901 | Axis |
| 2905 | Wall |
| 2910 | Wall |
| 2915 | Chamber |
| 2925 | Hole |
| 2930 | Plenum |
| 2935 | Fitting |
| 3000 | Station |
| 3005 | Support |
| 3010 | Surface |
| 3100 | Object |
| 3200 | Pad |
| 3205 | Axis |
| 3215 | Arrow |
| 3216 | Station |
| 3220-3240 | Arrow |
| 3250 | Head |
| 3300 | Head |
| 3500 | Pad |
| 3501 | Arrow |
| 3505 | Station |

DESCRIPTION

First Embodiment

Figure 3A:
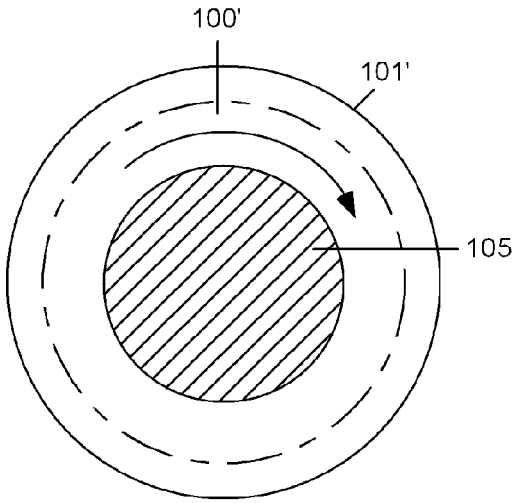
FIGS. 3A and 3B show side and front views of a rotary pad printing pad according to a first aspect of a first embodiment.
Figure 3B:
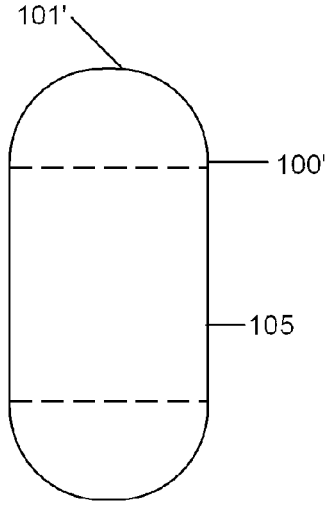

FIGS. 3A and 3B

FIGS. 3A and 3B show side and front views, respectively, of a rotary pad according to a first aspect of a first embodiment. In this aspect, the volume of flexible material comprising pad 100' (FIG. 3A) has a crowned surface 101'. Instead of having a right-circular cylindrical surface 101 (FIG. 1), surface 101' of pad 100' is bulged in its relaxed state. As in the prior-art pad, pad 100' is bonded to a shaft 105. Shaft 105 is urged to rotate by a rotary drive mechanism (not shown). Pad 100' and shaft 105 turn together in the direction indicated by the arrow. Pad 100' is made of a resilient elastomer such as silicone rubber. The outer diameter of the pad is typically between one and 20 cm, although other sizes can be used. The width of the pad in the axial direction is typically between 0.5 and 10 cm, although other sizes can be used.

A pad according to this embodiment is useful in a system such as the one disclosed in our above co-pending patent application Ser. No. 11/777,166. In this application, an ink source, such as an inkjet printing head, is used to apply one or more inks or other optional substances and treatments to surface 101' of pad 100' for subsequent transfer to a receiving surface (not shown).

Figure 4A:
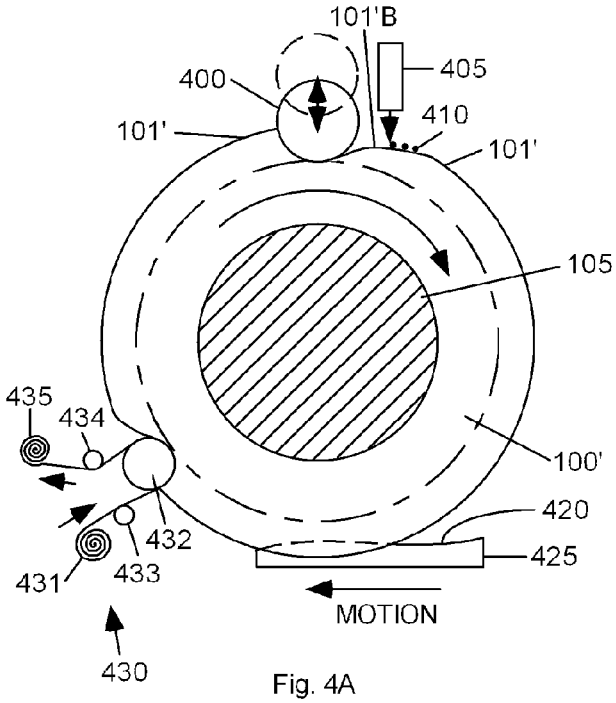
FIGS. 4A and 4B show side and front views of a system for temporarily flattening a portion of a pad printing pad according to an aspect of the first embodiment.
Figure 4B:
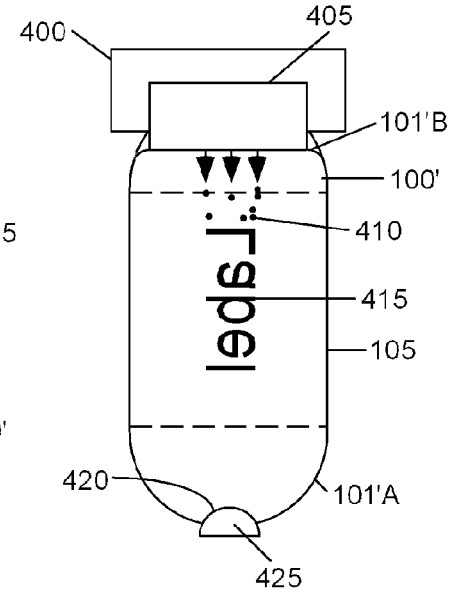

An inkjet printing head has a maximum "throw" distance of approximately 3 mm. This is the distance over which ink droplets can be sent from the inkjet head to a receiving surface without significantly deviating from their path. If the droplets deviate from their path, the printed image will be distorted. Therefore, if an inkjet head (not shown) is used to apply ink to surface 101', as taught in our previously-mentioned pending application, the curvature of surface 101' must be limited. In cases where the curvature of surface 101' cannot be limited to a value small enough to prevent distortion of an ink image, then surface 101' must be flattened at the point where an ink image is applied. FIGS. 4A and 4B show this flattening in detail.

Operation

First Embodiment

FIGS. 4A and 4B

FIGS. 4A and 4B show side and front views, respectively, of a system for temporarily flattening a crowned pad. One aspect of this embodiment comprises pad 100' with a crowned surface 101', a roller 400, and an ink source 405 for printing an image comprising droplets or spots of ink 410 (shown greatly enlarged) that optionally coalesce into an image 415 (FIG. 4B). Drops 410 and image 415 are to be transferred to a surface 420 of a receiving object 425, such as a toothbrush handle, syringe, thermometer, etc. During transfer of image 415 and drops 410 to surface 420, object 425 is urged into contact with pad 100' in such a way that their surface speeds are equal, thus preventing smearing of ink drops 410 and image 415.

A well-known controller (not shown), generally comprising a microprocessor or microcomputer, monitors and controls all aspects of the printing operation of this embodiment.

Roller 400 rotates about its axis and is supported by bearings (not shown). During printing, it is urged into contact with pad 100'. The surfaces of roller 400 and pad 100' move at the same speed, thereby avoiding undue wear on pad 100'. Roller 400 can be made of a metal or sturdy plastic, or a combination of the two. Alternatively, for short-term use, roller 400 can be a non-rotating rod with a smooth surface capable of sliding on surface 101'. In another aspect, roller 400 can be raised above surface 101' when it is not necessary to deform pad 100'. Raising and lowering roller 400 can be done manually or automatically under the control of a well-known control unit (not shown).

Roller 400 locally compresses surface 101' of roller 100', thereby locally and temporarily creating a depression and changing its shape from that indicated at 101' to the concave or depressed, trough-like shape indicated at 101'B. At 101'B, the surface of roller 100' is nearly flat. In this condition, the throw distance of ink source 405 is not exceeded and it can successfully apply an image to roller 100'.

As pad 100' turns, the part of surface 101' not underneath roller 400 becomes convex or crowned again due to the resilience of pad 100'. Image 415 and drops 410 move downward and are finally applied to surface 420 of object 425. The crown and circumferential curvatures of pad 100' enable printing on surface 420, provided pad 100' is sufficiently flexible to conform intimately to surface 420.

After transfer of image 415 and droplets 410 to surface 420, surface 101' of pad 100' is optionally cleaned using a cleaning applicator, in well-known fashion. This is normally done using a web of adhesive tape, blotting paper or the like, that is pressed against surface 101'. A cleaning station 430 is shown in FIG. 4A. Adhesive tape or blotting paper from a supply roll 431 is fed around a shaft 432 using optional guides 433 and 434. Shaft 432 is positioned so that the adhesive surface of the tape or blotting surface of the blotting paper is brought into contact with the image area on pad 100' after the image is transferred to surface 420 of object 425. The surface speeds of roller 100' and the tape or blotting paper are equal, i.e. there is no slippage between the two. Any residual ink droplets 410 and image areas 415 remaining after transfer of the droplets and image to surface 420 of object 425 are removed by the tape or blotting paper. Shaft 432 can either turn or remain stationary.

Using this embodiment, images 415 can be of any length and continuously transferred to surface 420, thereby enabling printing on objects 425 whose length is greater than the circumference of roller 100'. In addition, crowned surface 101' can conform to curved surface 420, thereby enabling printing over the full width of object 425.

DESCRIPTION AND OPERATION

Alternative Embodiment

FIGS. 5 through 6B

FIGS. 5, 6A and 6B show side and cross-sectional views of a system for temporarily bulging a non-crowned, rotary printing pad. Instead of a normally bulged surface, the present embodiment comprises a normally right-circular cylindrically shaped pad that is temporarily bulged for transfer of an ink image (not shown) to a receiving object. This embodiment includes an elastomeric rotary pad 500 with an axle 505, a flat surface portion 510, an ink, coatings, and treatments applicator assembly 515, and deforming pinch rollers 520 and 525 having axles 530 and 535, respectively. Arrow 545 (FIG. 5) indicates the direction of rotation of pad 500 during operation. As pad 500 rotates, rollers 520 and 525 squeeze a portion of pad 500, temporarily causing surface 510' to assume a bulged shape during transfer of an ink image (not shown) to the surface of an object 600 (FIG. 6A). Assembly 515 is optionally arranged to move in a direction parallel to axis 505 of pad 500 in order to provide full coverage over surface 510, as indicated by arrow 540 (FIG. 6A). FIG. 6A shows an object 600 about to receive ink from pad 500. FIG. 6B shows object 600 in contact with pad 500, receiving an image.

In use, pad 500 rotates on axle 505. Applicator assembly 515 applies an image and any optional coatings and treatments to surface 510 of pad 500 while surface 510 is flat. Coatings include shellac, varnish, plastic resins, paints, catalysts, and any other coating that is compatible with an ink image. These can be applied as undercoatings or overcoatings. Treatments include plasma, corona, electromagnetic radiation of any kind, sonic and ultrasonic radiation, heat, cold, gases, sprays, and powders. Portion 510' of pad 500 is deformed as it passes through pinch rollers 520 and 525. Rollers 520 and 525 rotate on axles 530 and 535, respectively. Axles 530 and 535 are supported by an external mechanism (not shown) and they can be urged closer together or farther apart, as required, to adjust the amount of pinch, and therefore the extent of the bulge, on pad 500. More pinching force applied between rollers 520 and 525 will cause pad 500 to bulge more, while less pinching force will cause pad 500 to bulge less.

After application of an ink image (not shown) by assembly 515, the ink image eventually reaches the bottom of rotary pad 500, whereupon surface 510' bulges under the urging of rollers 520 and 525. At this point, the surface of object 600 is brought into contact with surface 510 and the ink image is transferred to the surface of object 600 (FIG. 6B).

In a first aspect, pad 500 continues to rotate during transfer. In this case, object 600 is caused to move so that its surface and that of pad 500 move at the same speed to avoid smearing the image. In an alternative aspect, an ink image is applied to pad 500, pad 500 is rotated so that its surface is curved by pinch rollers 520 and 525 at the position of the ink image, and pad 500 is then stopped. While pad 500 is stopped, object 600 is placed at a stationary position beneath pad 500 and surface 510' is urged against the surface of object 600, thereby transferring the image.

Pad 500 is made of any durable elastomer, such as silicone rubber, that has properties suitable for pad printing. Its hardness value is in the range of 5 to 85 durometer (Shore), although other hardnesses can be used. In this aspect of the embodiment, the diameter and width of pad 500 are 20 cm and 5 cm, respectively, although other sizes can be used. All other components are scaled accordingly as indicated in FIGS. 5, 6A, and 6B. Rollers 520 and 525 can be made of a metal such as steel, or a sturdy plastic material. The speed of rotation of pad 500 is between 0.1 and 100 RPM, although other speeds can be used.

The present embodiment permits writing of an ink image while surface 510 of pad 500 is parallel and in close proximity to ink applicator assembly 515, thereby minimizing the ink throw distance between assembly 515 and surface 510 and resulting in a high-quality image. At the transfer step, surface 510' is bulged, thereby avoiding entrapment of air at the transfer step and permitting surface 510' to fully conform to the surface of object 600, resulting in a high-quality transferred image.

Alternative Embodiment

FIGS. 7 through 10

Instead of a pad wheel, a belt, as taught in our above-mentioned co-pending application, can be used. This arrangement is advantageous in that ink, treating, and coating apparatus can be organized in a linear arrangement, instead of a curved one. FIGS. 7 through 10 show side and cross-sectional views of a system for temporarily bulging a flat pad printing belt. The volume of flexible material comprising the belt is flat while the image is applied, and then caused to bulge at the point of transfer of the image to the surface of a receiving object.

As shown in FIGS. 7 through 10, this aspect comprises at least the following: a belt 700, one or more application stations 702 optionally including an ink source 702', a coating source 702", a treatment station 702''', a cleaning station 702'''', and the like, pads 705 and 706, pinch rollers 710, 715, and optionally pad 720, which turn on axes 711, 716, and 721, respectively, and an object 725 to be printed or decorated. As above, belt 700 comprises an elastomeric material that is suitable for use in this mechanical arrangement and also suitable for use with pad printing.

Figure 7:
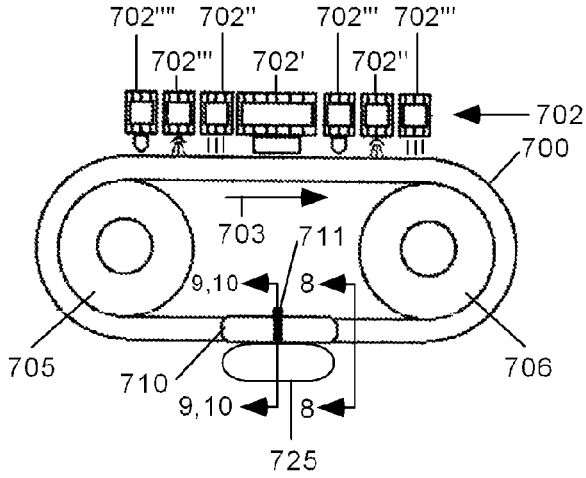

In operation, belt 700 is supported by rollers 705 and 706. One or both of rollers 705 and 706 is driven by an external mechanism (not shown). If only one roller is driven, the other roller coasts. Stations 702 apply ink and optional coatings and treatments to the top of belt 700 as it moves in a direction indicated by arrow 703 (FIG. 7). An ink image 701 (FIG. 8) has been applied and optionally treated by one or more stations 702. As ink image 701 (FIG. 8)*nears* the bottom of belt 700, object 725 is urged into contact with belt 700. Object 725 moves with belt 700 to prevent smearing of image 701. Alternatively, the printing system moves across the object at a speed equal to the rotating belt to prevent smearing of image 701. In another aspect, belt 700 is stopped when image 701 reaches the bottom and object 725 is pressed against belt 700 in order to transfer the image from belt 700 to object 725.

Figure 8:
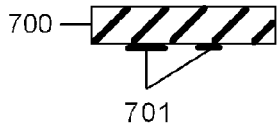

FIG. 8 shows an ink image 701, plus any treatments and coatings, on belt 700.

Figure 9:
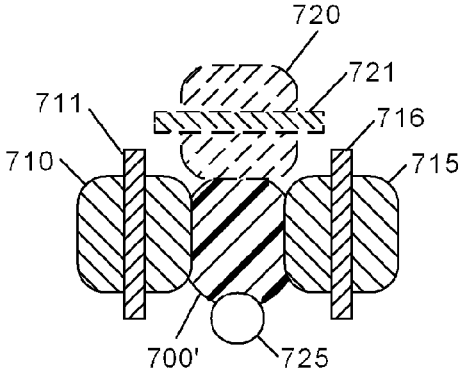
Figure 10:
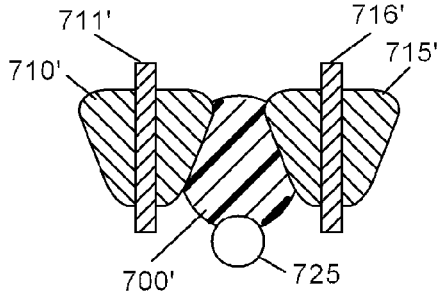

FIGS. 9 and 10 show the condition of belt 700 as it is squeezed from the side by rollers 710 and 715. In FIG. 9, an optional roller 720 is added to further restrain belt 700 and urge it into contact with object 725. Rollers 710, 715, and 720 rotate with axles 711, 716, and 721 that are held in place in an external mount (not shown).

FIG. 10 shows a variation of the system of FIG. 9. Instead of rollers 710 and 715 being cylindrical as in FIG. 9, they are conical sections, as shown in FIG. 10. The use of conical rollers causes belt 700' to be squeezed and also restrained from moving vertically in a direction away from receiving object 725. Therefore, belt 700' maintains contact with object 725 and the force between them provides sufficient pressure to transfer image 701 from belt 720 to object 725.

This embodiment permits arrangement of applicators 702 in a linear array above belt 700, thereby simplifying assembly of the embodiment. The surface of belt 700 is flat during application of image 701 (FIG. 8), resulting in a minimal throw distance for ink droplets comprising image 701, while belt 700 is bulged at the transfer step (FIGS. 9 and 10) for a high-quality transfer of image 701 to the surface of object 725.

Alternative Embodiment

FIGS. 11A through 11C

Instead of a normally flat surfaced belt, a normally bulged belt can be used. FIGS. 11A-11C show side and cross-sectional views of a normally crowned belt pad that is flattened for application of an ink image and optional coatings and treatments. In this aspect, a normally-crowned or bulged belt 1105 is used. Rollers 1100 and 1101 temporarily compress a crowned belt 1105 in the vicinity of a print head 1110, as shown in detail in FIG. 11B. This is similar to the flattening of pad 100' in FIGS. 4A and 4B. An ink image is applied to belt 1105 and optionally coated and treated as described above in connection with the various embodiments. Belt 1105 continues to rotate and is finally pressed into non-sliding contact with an object 1115, as shown in FIG. 11C, whereupon the image is transferred to object 1115.

This embodiment permits the use of belt 1105 that is formed into a crowned shape, then flattened for application of an ink image (not shown) by applicator 702'. A short ink throw distance is maintained by rollers 1100 and 1101, while the crowned shape of belt 1105 ensures a high-quality transfer of ink image and coatings to the surface of object 1115 (FIG. 11C).

Alternative Embodiment

FIGS. 12A through 12C

Instead of a rotary, bulging pad or belt, a rotary, bulging wheel can be used. FIGS. 12A through 12C show side and cross-sectional views of a pad wheel 1200 comprising a series of chambers 1205. Chambers 1205 are bounded by rigid inner walls 1210, a central annular portion 1215, and a flexible outer wall 1220. Wall 1220 is made of silicone rubber, for example. Walls 1210 and portion 1215 can be made of metal, plastic, or wood. Side walls 1718 and 1719 (FIG. 12B) of pad wheel 1200 are rigid. Each chamber 1205 is provided with an air hole 1225. As wheel 1200 rotates, holes 1225 are sequentially coupled to an air source 1230 via a plenum 1235. An O-ring seal 1240 (FIG. 12B) prevents leakage of air while plenum 1235 is connected to any of holes 1225. Chambers 1205 are normally not bulged. Bulged chambers 1205' are shown at the bottom of FIG. 12A. Not-bulged chambers 1205 comprise the remainder.

In operation, an ink image and treatments are applied to the image and the surface of wheel 1200, as described in connection with the above embodiments. As wheel 1200 rotates, chambers 1205' are forced to bulge by the injection of compressed air from source 1230 (FIGS. 12A and 12B). As in the previous embodiments, the bulged surfaces of chambers 1205' are brought into non-sliding contact with the surface of a receiving object 1245 and the image is transferred to the receiving object (FIG. 12C).

Alternative Embodiment

FIGS. 13A through 13C

Instead of a pad wheel that is normally flat and temporarily bulges under pressure, a pad wheel that is normally bulged, and temporarily flattened using a vacuum can be used. FIGS. 13A-13C show side and cross-sectional views of a pad that is flattened by a vacuum. The embodiment shown in FIGS. 13A-13C operates in a manner similar to that of the embodiment in FIGS. 12A-12C. In FIGS. 13A and 13B, a pad wheel 1300 comprises a series of chambers 1305. Chambers 1305 are normally in a bulged condition. Instead of a pressure source that causes chambers 1300 to bulge, a vacuum source 1310 is coupled to chambers 1305' through a plenum 1315 and sliding joint 1320 that sequentially mates with holes 1325 as wheel 1300 turns. When source 1310 is connected to a chamber 1305' via a hole 1325, chamber 1305' becomes flat and able to accept ink from head 702'. When hole 1325 is open to ambient air pressure, chamber 1305' is bulged and can transfer an image (not shown) to the surface of a receiving object 1245 (FIG. 13C).

Alternative Embodiment

FIGS. 14A and 14B

Instead of using pressure or a vacuum to change the surface shape of a pad wheel, an internal mechanism can be used. FIGS. 14A and 14B show cross-sectional views of a rotary pad wheel 1400 with an internal bulging wheel 1405. Wheel 1400 is driven to rotate about its central axis by a drive pulley 1410 connected to one of hollow axles 1411. Internal bulging wheel 1405 is connected to external actuating levers by arms 1415. Bulging wheel 1405 rotates on bearings (not shown) connected to the ends of arms 1415. Arms 1415 are connected to external lever arms 1420 by shafts 1425. Axles 1411 and shafts 1425 are supported by support bearings 1430.

In use, a print head 702' applies an ink image (not shown) to pad 1400 as pad 1400 rotates. When it is desired to transfer an image to a receiving surface (not shown), wheel 1400 is bulged by rotating arms 1420 until bulging wheel 1405 causes pad 1400 to bulge outward, as shown in FIG. 14A. When it is desired to leave pad 1400 in a not-bulged condition, lever arms 1420 are rotated about shafts 1425 until wheel 1405 no longer contacts the inside surface of pad 1400. Arms 1420 can be actuated manually or by an external mechanism (not shown).

Alternative Embodiment

FIGS. 15A through 15C

Instead of temporarily bulging the pad using internal forces (including vacuum, pressure, and mechanical means as described above), the pad can be bulged by forcing it against an external constraint. FIGS. 15A through 15C show side and frontal views of a rotary pad that is radially bulged by forcing it against a hole in a plate. In this aspect, a pad wheel 1500 receives an ink image and treatments from a print head 702' and other treatment stations (not shown). Wheel 1500 is suspended above a plate 1510 having a hole 1515. Hole 1515 can be circular, square, oval, hexagonal, rectangular, and the like. When the ink image reaches the bottom region 1501, the axle 1502 of pad 1500 stops rotating and is urged downward against plate 1510 by an external mechanism (not shown), causing pad 1500 to bulge through hole 1515. While pad 1500 is so bulged and projecting through hole 1515, pad 1500 and plate 1510 are moved downward together and bulged surface portion 1501 carrying the ink image is forced against the top surface of a receiving object 1520. The ink image is thereby transferred to the surface of object 1520, completing the print job (FIG. 15C). After transfer, pad 1500 is removed from contact with plate 1510, permitting portion 1501 to retract through hole 1515, and pad 1500 again assumes a circular shape. In this condition, pad 1500 is again ready to receive a new ink image.

Alternative Embodiment

FIGS. 16 through 18

Instead of writing onto and transferring from the circumferential surface of a pad, the side of the pad can be used. FIGS. 16 through 18 show cross-sectional views of pads configured for side-of-the-pad writing and transfer. In this aspect, a pad wheel 1600 comprises silicone rubber or other suitable pad printing material. Wheel 1600 is shown in a side view in FIGS. 16 through 18. Wheel 1600 is supported by and rotates on an axle 1615. Instead of writing on the outer circumference of the wheel, as described above, a print head 702' which employs inkjet or another printing modality such as electrostatic, spray, or the like, is positioned adjacent the side of wheel 1600. Head 702' also incorporates any treatment stations such as described above, including but not limited to radiative, spray, inkjet, electrostatic, and the like. Head 702' can be arranged to move radially as shown by arrow 1610 in order to print an image over a greater extent of the side of wheel 1600 than reachable by the width of head 1605 alone. Other possible trajectories for head 1605 are discussed below in connection with FIGS. 29-31.

FIG. 16 shows pad wheel 1600 reinforced by a backing plate 1602. Plate 1602 rotates on axle 1615. Plate 1602 can be made of metal, plastic, or wood. In cases where little force is required to transfer an image to a receiving object, plate 1602 can be omitted. FIG. 17 shows wheel 1600 without a backing plate. Plate 1602 and wheel can be any suitable diameter from as little as one cm to 25 or more cm. Pad 1600 can be any thickness from less than one centimeter to 10 or more cm. Backing plate 1602 can be any thickness from about 0.5 to one or more cm, as required to support pad 1600 during transfer of the image (described below).

In use, an ink image and any required treatments are applied to the side of wheel 1600 as it rotates about axis 1615. During application of an image to wheel 1600, wheel 1600 can rotate 180 degrees or more, as required to complete the application of an image and any required coatings and treatments. When the image and treatments are complete, wheel 1600 is brought into stationary or non-smearing contact with the surface of a receiving object 1800 (FIG. 18). The image and any desired coatings and treatments are thereby transferred to object 1800. This completes the transfer process. After transfer, wheel 1600 can be cleaned, if necessary, and another image and any desired treatments and coatings applied in preparation for another transfer. Each image, each coating, and each treatment can be different, if required.

Alternative Embodiment

FIGS. 19 through 21

In some cases, printing of images can be accomplished using the side of a pad wheel that is normally bulged and temporarily flattened for application of an ink image. FIGS. 19 through 21 show cross-sectional views of a bulged variation of the pads in FIGS. 16-18. FIG. 19 shows a normally bulged pad wheel 1900 with a bulged region 1905 and a backing plate 1902, similar to plate 1602, and an axle 1901, similar to axle 1615 (FIG. 16). A roller or other flattening agent such as a flat sliding surface 1910 flattens bulged region 1905 in the neighborhood of a print head, coating, and treatment station 1920 in order to permit application of an image and any desired coatings and treatments to the surface of wheel 1900 while it is flat. After rotating away from the region of station 1920, wheel 1900 is allowed to bulge again. This aspect of the embodiment operates in a manner similar to that shown in FIGS. 4A and 4B in which the curvature of the wheel is temporarily flattened to permit application of the ink image and any treatments or coatings to a flat surface.

FIG. 19 shows pad 1900 with bulge 1905 on one side only. The other side of pad 1900 is backed with backing plate 1902. Pad 1900 and plate 1902 have the same or similar dimensions to those given above in the previous aspect shown in FIGS. 16-18.

As in the previous aspect, wheel 1900 turns about axis 1901 while head station 1920 applies an image and any desired coatings and treatments to the surface of pad wheel 1900. When the image is ready for transfer, pad 1900 is pressed against the surface of a receiving object 2005 (FIG. 21), as described in connection with the previously described aspect.

FIG. 20 shows an aspect similar to that in FIG. 19, except pad wheel 2000 contains bulges 2001 and 2002 on two surfaces and there is no backing plate. Rollers 2005 and 2010 temporarily compress bulges 2001 and 2002 in wheel 2000 in the region of print head 1920', thereby providing a flat surface for head 1920' to optionally apply ink, treatments, and coatings to the surface of wheel 2000. As in the previous embodiment, head 1920 can be moved over the surface of pad 1900 in order to create an image that is larger than the length of head 1920.

FIG. 21 shows pad 2000 being pressed against the surface of a receiving object 2005 in order to transfer the previously-applied image and optionally any coatings or treatments to object 2005. Alternately, pressure may be applied to bulge 2001 at the time of image transfer by mechanical means (not shown) to prevent distortion of pad 2000 and facilitate a solid transfer of the image to the object.

Alternative Embodiment

FIGS. 22 and 23

In another variation, FIGS. 22 and 23 show cross-sectional views of a pad that is axially-bulged by forcing it against a hole in a plate. In this aspect, a pressure anvil 2207 and a plate 2205 with an aperture 2210 are added to the embodiment of FIG. 17. As in the previous aspects, an elastomeric pad wheel 2200 rotates about an axis 2202 and receives an ink image plus any optional treatments and coatings from head station 702'. When the image and treatments are complete, pad 2200 rotates until the image to be transferred is located over aperture 2210. At this point, the rotation of pad 2200 with respect to aperture 2210 is stopped. Anvil 2207 moves downward against pad 2200, forcing a bulged region 2206 to temporarily extrude through aperture 2210 and beneath plate 2205. FIG. 23 shows the urging of bulged region 2206 of pad 2200 against the surface of a receiving object 2215, whereupon the image and any predetermined treatments and coatings are transferred. After transfer, anvil 2207 moves upward until it no longer contacts pad 2200. Pad 2200 can then rotate, receive an image, and be positioned for a subsequent transfer.

Alternative Embodiments

FIGS. 24 through 29

Pressure and Vacuum Activated Axial-Direction Bulges on Pad Wheels

Pressure Activation

FIGS. 24 through 26 are side and cross-sectional views of a pad that bulges axially, instead of radially as in FIGS. 12A-12C, when pneumatic or hydraulic pressure is applied to the interior of the pad.

In this aspect, a pad wheel 2600 is provided with inner chambers 2605 and an axis 2601. One or more of chambers 2605 further includes an air hole 2610 through which compressed air is supplied via a plenum 2612 from an air source 2615. A sliding seal 2613 prevents air leakage. The side of wheel 2600 that is opposite plenum 212 is made of a flexible pad-printing material such as silicone rubber. The remainder of wheel 2600 is made of rigid plastic, metal, or wood. The flexible and rigid materials are bonded together at their interface. The normally flat, flexible surface of wheel 2600 is arranged to bulge when air pressure is applied through any of holes 2610 (FIGS. 27 and 28).

In use, a writing, treating, and coating station 2603 (FIG. 25) applies an image and any desired coatings and treatments (not shown) to the flat, flexible surface of wheel 2600. After application of the image and any treatments, wheel 2600 rotates about axis 2601 until the image is adjacent the surface of a receiving object 2620. Next, compressed air from source 2615 is supplied to chamber 2605 through plenum 2612, causing the flexible portion of pad 2600 to bulge in the region of pressurized chamber 2605. The act of bulging can bring the image on the surface of wheel 2600 into contact with a receiving object 2625, or object 2625 and wheel 2600 can be urged into contact through another means (not shown), thereby transferring the image and any desired coatings or treatments to object 2625.

Vacuum Activation

FIGS. 27 through 29 are side and cross-sectional views of a pad that bulges axially, instead of radially when a vacuum is selectively applied to the interior of the pad. FIG. 28 shows a normally bulged pad wheel 2900, capable of turning on an axis 2901, and having a rigid exterior wall 2905 and a series of rigid, inner walls 2910 forming and separating a series of chambers 2915. Each chamber 2915 has a flexible, normally-bulged top surface 2910' (FIG. 28). The remaining boundary surfaces of wheel 2900 are rigid.

Each of chambers 2915 further includes a hole 2925 enabling the passage of gas into and out of chambers 2915. A plenum 2930, fixed in space relative to the rotation of wheel 2900, communicates with chambers 2915 via holes 2925 as each of holes 2925 passes beneath plenum 2920. A fitting 2935 in plenum 2930 communicates with an external vacuum source (not shown). When any of holes 2925 are adjacent plenum 2930, the vacuum applied at fitting 2935 removes a portion of the gas within the associated chambers 2915. When gas is removed from a chamber 2915, bulged top surface 3010 (FIG. 28) flattens to a flat surface 2910'.

FIG. 28 shows pad wheel 2900 in a condition to receive an ink image, coatings, and various treatments from a head station 3000. A mesh support 3005 is optionally contained within each of chambers 2915 to render the top surface 3010' flat when a vacuum is drawn from within the chamber. Plenum 2930 is located opposite head 3000. Thus when any of chambers 2915 are in the vicinity of head 3000, plenum 2930 accesses holes 2925 of chambers 2915 in that same vicinity, causing the associated bulges 2910 to temporarily assume their flattened shape 2910', thereby permitting application of ink, coatings, and treatments to surface 2910' by head 3000. As wheel 2900 continues to rotate, as shown by the arrow in FIG. 27, air enters holes 2925 not covered by plenum 2930 and surface 2910 again bulges.

FIG. 29 shows a receiving object 3100 in contact with bulged surface 32910 of pad wheel 2900. By this contact, an ink, coating, and transfer image (not shown) is transferred from wheel 2900 to object 3100. Further treatments such as heating, coating, treating, and the like can be applied to object 3100, if desired.

In another aspect of this embodiment, a second plenum can be provided that applies pressure to bulged chambers 2915 in order to increase their rigidity.

Figure 32:
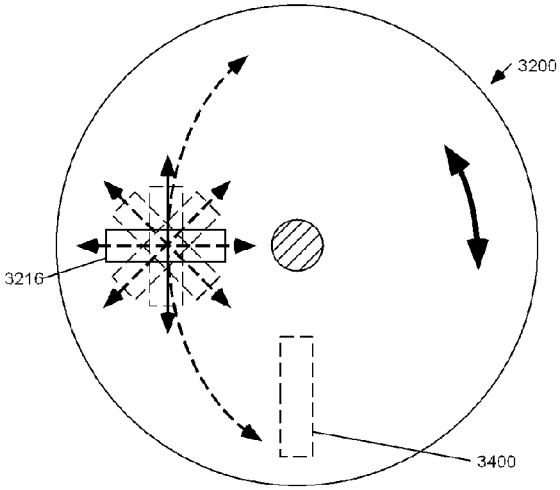

FIGS. 30 through 32

FIGS. 30 through 32 show various orientations and movements of writing heads and the pad during application of inks, coatings, and treatments to the side of a pad. FIGS. 30 and 31 show plan views of a pad wheel 3200 capable of rotating around an axis 3205 in the direction of arrow 3215. The motion of wheel 3200 as indicated by arrow 3215 can be continuous, or intermittent, forwards or backwards. A writing, coating, and treating station 3216 is positioned above wheel 3200 (FIG. 31), as described in connection with the various aspects of the embodiments shown above. The illustration in this embodiment applies equally to all previously-described aspects of the various embodiments shown.

In use, station 3216 can be stationary or can follow a number of possible trajectories. Arrows 3220-3240 in FIG. 32 indicate a number of possible trajectories for head 3250 to follow as it deposits ink, coatings, and treatments onto wheel 3200. Any predetermined trajectory of combination of trajectories can be used.

FIG. 31 shows a side view of head station 3216 and pad wheel 3200. In addition to the trajectories shown in FIG. 30, head 3216 can also move toward or away from wheel 3200 during operation. The motion of head 3216 can be continuous, intermittent, up, or down relative to the surface of wheel 3200.

FIG. 32 shows a number of possible orientations of head 3216 with respect to wheel 3200. The orientation of head and its position can be stationary or can change during application of an ink image, treatments and coatings to wheel 3200.

Wheel 3200, and heads 3216 and 3100 are supported and moved by external mechanisms (not shown) under the control of a control unit (not shown).

FIGS. 33 through 36

FIGS. 33 through 36 show various alternative motions and orientations of a pad wheel 3500 and a writing, coating, and treatment station 3505.

Figure 33:
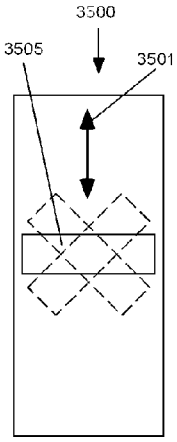

In FIG. 33, a pad wheel 3500 rotates either forward or backward, as indicated by arrow 3501. During the writing process in which an ink image and optional coatings and treatments (not shown) are applied to wheel 3500, station 3505 can assume any angular orientation desired, as indicated by its outline in dashed lines. Station 3505 can rotate to different angles during writing, and wheel 3500 can start and stop, as required to deposit the desired image.

Figure 34:
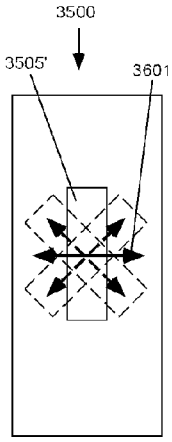

In FIG. 34, wheel 3500 is optionally stopped while station 3505' applies inks, coatings, and treatments to wheel 3500. Station 3505' can rotate and move in any direction with respect to wheel 3500. The rotation and motion can be continuous or intermittent. Wheel 3500 can also move during the writing process, if required.

Figure 35:
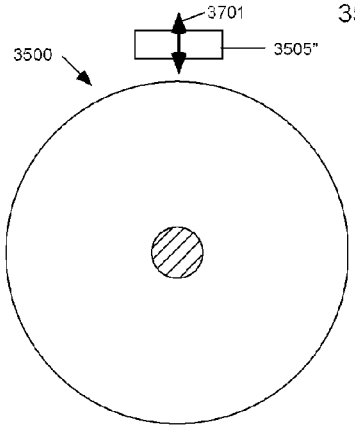

In FIG. 35, station 3505" is moved toward or away from wheel 3500 during writing, as required to write, coat, and treat an image. The motion of station 3505" relative to wheel 3500 can be fixed, or variable under control of a control unit (not shown). Again, the relative motions of wheel 3500 and station 3505" can be intermittent or continuous, as required to form and later transfer the desired image, coatings, and treatments on wheel 3500.

Figure 36:
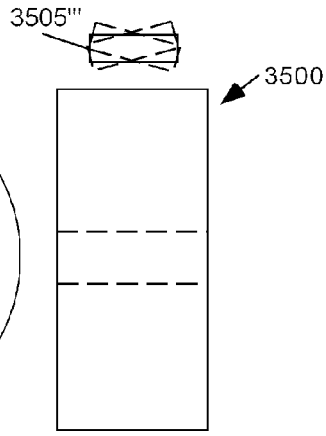

In FIG. 36, station 3505"' can tilt with respect to the surface of wheel 3500. The degree of tilt can be fixed, or variable under control of a control unit (not shown).

CONCLUSIONS, RAMIFICATIONS, AND SCOPE

The embodiments shown in various aspects of our improved pad printing methods and apparatuses incorporate an inking station and a flexible, moving surface. An inking head, such as an inkjet, applies an ink image to the moving surface. The ink image on the surface is further optionally treated by one or more stations comprising emissive and radiative sources, spray sources, vapor sources, and the like. These sources provide overcoats, undercoats, additional chemical reactants and catalysts, additional ink colors, heat, infrared, visible, and ultraviolet light, and flames.

As described, the pads and belts that convey the ink image and any treatments and coatings, are caused to bulge in order to facilitate transfer of the image, and coatings and treatments, to a receiving object. By bulging, the pads and belts avoid trapping of air at the transfer surface, thereby permitting application of a high-quality image. Alternatively, the pads and belts that convey the ink image and any treatments and coatings, may not be caused to bulge in order to facilitate transfer of the image, and any coatings and treatments to a receiving object. Instead, they can be left in their not-bulged condition if desired. The embodiments described work within the requirements of ink image sources, such as inkjet heads, by assuming a flat condition along at least a line beneath the source. At the point of transfer of the ink image and any coatings to a receiving surface, the pads are bulged in order to faithfully transfer a high-quality image to the receiving surface. Alternatively, the pads can be flat, if desired.

While the above description contains many specificities, these should not be considered limiting but merely exemplary. Many variations and ramifications are possible. The pads can be made of a variety of materials including natural and silicone rubbers, gelatin, plastics, and the like. They can be large, on the order of tens or hundreds of centimeters in width and diameter, or small, less than a centimeter in width and diameter, or any size in-between as determined by the size of the image to be transferred. The embodiments can be operated at high or low temperatures, humidities, and pressures.

While the present system employs elements which are well known to those skilled in the art of pad printing, it combines these elements in a novel way which produces one or more new results which we believe have not heretofore been discovered. Accordingly the scope should be determined, not by the embodiments illustrated, but by the appended claims and their legal equivalents.

The invention claimed is:

1. An apparatus for rotary pad printing of an image onto an object, comprising:

an ink applicator having a predetermined length and is capable of applying an ink image, a rotary pad with a deformable surface that is capable of assuming a bulged shape, means for rotating said rotary pad so that a portion of said surface of said rotary pad is adjacent said ink applicator at a first time and adjacent said object at a second time, first shaping means for temporarily shaping said portion of said surface of said rotary pad while said portion of said surface of said rotary pad is adjacent said ink applicator so that said portion of said surface of said rotary pad adjacent said ink applicator is substantially parallel to and equidistant from said ink applicator along the length of said ink applicator, means for causing said ink applicator to apply said ink image directly to said portion of said surface of said rotary pad while said portion of said surface of said rotary pad is adjacent said ink applicator, second shaping means for causing said portion of said surface of said rotary pad to assume said bulged shape, means for urging said portion of said surface of said rotary pad against said object while said portion of said surface of said rotary pad has said bulged shape, whereby said ink image can be applied to said portion of said surface of said rotary pad while said portion of said surface of said rotary pad is adjacent said ink applicator and then said portion of said surface of said rotary pad can be brought into contact with said object while said portion of said surface of said rotary pad has said bulged shape, thereby transferring said ink image to said object.

2. The apparatus of claim 1 wherein said rotary pad is selected from the group consisting of cylinders and belts.

3. The apparatus of claim 1, further including at least one additional applicator selected from the group consisting of treatment, coating, and cleaning applicators.

4. The apparatus of claim 3, further including means for moving said additional applicator relative to said surface of said rotary pad.

5. The apparatus of claim 1 wherein said rotary pad is capable of motion, said motion selected from the group consisting of intermittent and continuous motions.

6. The apparatus of claim 1, further including means for moving said applicator relative to said surface of said rotary pad.

7. A method for pad printing an ink image onto an object, comprising:

providing a rotary pad with a resilient deformable surface, providing an ink applicator for applying an ink image to said rotary pad, positioning said ink applicator a predetermined distance from said rotary pad, providing a first shaping mechanism for temporarily causing a portion of said surface of said pad to assume a first shape that is parallel to and at said predetermined distance from said ink applicator while said portion of said surface of said pad is adjacent said ink applicator, causing said ink applicator to apply said ink image to said rotary pad while said portion of said surface of said rotary pad has said first shape, providing a second shaping mechanism for temporarily causing said portion of said surface of said rotary pad to assume a second shape that is bulged, causing said second shaping mechanism to cause a said portion of said surface to assume said bulged shape, and urging said portion of said surface of said rotary pad containing said ink image into contact with said object, thereby transferring said ink image to said object.

8. The method of claim 7 wherein said ink applicator is an inkjet.

9. The method of claim 7 wherein said rotary pad is selected from the group consisting of cylinders and belts.

10. The method of claim 7, wherein said second shaping mechanism for temporarily causing said portion of said surface to assume said second shape is selected from the group consisting of rollers, rods, vacuum, pressure, and apertures.

11. The method of claim 7, further including at least one additional applicator selected from the group consisting of treatment, coating, and cleaning applicators.

12. The method of claim 7 wherein said rotary pad is capable of motion, said motion selected from the group consisting of intermittent and continuous motions.

13. The method of claim 7, further including means for moving said applicator relative to said surface of said rotary pad.

14. An apparatus for rotary pad printing an ink image onto an object, comprising:

a volume of resilient material having a configuration selected from the group consisting of belts and cylinders, said volume of resilient material having an outer surface capable of being urged to assume first and second shapes at respective predetermined first and second locations on said outer surface, said first shape being formed so that a portion of said surface at said first location assumes a not-bulged shape, said second shape being bulged, said volume of resilient material further being rotatable, an ink applicator connected to an ink source, means for positioning said ink applicator within a predetermined distance from said volume of resilient material, means for causing said ink applicator to apply said ink image directly to said volume of resilient material when said portion of said surface of said volume of resilient material assumes said first shape within a predetermined distance from said ink applicator, means for urging said portion of said surface of said volume of resilient material to assume said first shape at said first location thereon, said means for urging said portion of said surface to assume said first shape arranged to cause said surface of said volume of resilient material to assume said not-bulged shape so that said ink applicator can apply an ink image directly to said volume of resilient material, and means for urging said portion of said surface of said volume of resilient material to assume said second shape at said second location thereon, said means for urging said portion of said surface to assume said second shape arranged to cause said volume of resilient material to assume said second shape when said ink image on said portion of said surface is in the vicinity of said object with a receiving surface capable of receiving said ink image, means for urging said volume of resilient material to rotate and move said portion of said surface thereof within said predetermined distance from said ink applicator, whereby while said volume of resilient material rotates, said ink image is printed onto said portion of said surface of said volume of resilient material at said first location where said portion of said surface is in said first shape and then said ink image is transferred to said receiving surface by urging said portion of said surface of said volume of resilient material into contact with said receiving surface while said surface of said volume of resilient material is in said second shape.

15. The apparatus of claim 14 wherein said ink applicator is an inkjet.

16. The apparatus of claim 14 wherein said volume of resilient material is capable of temporarily receiving and later releasing applications selected from the group consisting of treatment, coating, and cleaning applications.

17. The apparatus of claim 14, further including means for supporting said volume of resilient material.

* * * * *